US006161349A

United States Patent [19]

Carr

[11] Patent Number: 6,161,349

[45] Date of Patent: Dec. 19, 2000

[54] SYSTEM AND METHOD FOR FABRICATING ENCLOSURES

[75] Inventor: Jeffrey N. Carr, Johnstown, Pa.

[73] Assignee: Dynacom Industries, Inc.

[21] Appl. No.: 09/359,261

[22] Filed: Jul. 22, 1999

[51] Int. Cl.[7] ..... E04B 1/00

[52] U.S. Cl. ..... 52/270; 52/284; 52/592.6

[58] Field of Search ..... 52/270, 19, 20, 52/271, 262, 284, 592.5, 592.6, 650.3

[56] References Cited

U.S. PATENT DOCUMENTS

| | | | |
|---|---|---|---|
| 3,350,824 | 11/1967 | Wiebusch | 52/270 |
| 4,584,801 | 4/1986 | Weinberger | 52/270 X |
| 5,072,554 | 12/1991 | Hayman | 52/284 X |
| 5,344,700 | 9/1994 | McGath et al. | 52/270 X |
| 5,412,916 | 5/1995 | Kennedy et al. | 52/270 X |
| 5,813,180 | 9/1998 | Whitney et al. | 52/270 |
| 6,035,583 | 3/2000 | Papke | 52/270 X |

OTHER PUBLICATIONS

Publication by Lucent Technologies entitled "Cabinet Enhancement Services", 3 pages.

*Primary Examiner*—David M. Purol
*Attorney, Agent, or Firm*—Cohen & Grigsby, P.C.

[57] ABSTRACT

A turndown pad (20) having a deck panel sub-assembly (22) that is connected to side-wall sub-assemblies (24) by corner pultrusion members (26) and that is supported by a mounting pultrusion member (98). The deck panel sub-assembly (22) and the side-wall sub-assemblies (24) are constructed of lateral arrays of panel members (34). Selected side-wall sub-assemblies (24) are constructed of parallel lateral arrays of panel members (34) and pad (20 can also further include a portal trim member (110). In alternative embodiments, pad (20) can cooperate with an extension (120) and a platform anchor (124).

24 Claims, 14 Drawing Sheets

SYSTEM AND METHOD FOR FABRICATING ENCLOSURES

BACKGROUND OF THE INVENTION

1. Field of the Invention

The subject invention relates to apparatus and methods for enclosures of the type that are used in the installation and maintenance of electrical and electronic equipment and, more specifically, methods and apparatus for preassembly and installation of subterranean enclosures of the type that are used in communications networks.

2. Description of the Prior Art

Communications systems have been under continual development for many years. More recently, developments relating to various communication media, including fiberoptic, microwave, and electrical networks, have accelerated the rate at which communications systems as well as other information and control systems are being revised and improved.

To utilize these continued advances in technology, it has become necessary for both users and providers of these systems to more frequently update and improve the system components. This has resulted in more frequent and often more technically complex modifications and improvements than have been previously required. The increasing complexity of communications systems and other affected systems and the somewhat delicate nature of the system components also has made installation of the system improvements increasingly more complex and costly. Moreover, the environment in which many installations must be made has often made such field installations more vulnerable to human errors and component failures.

Accordingly, the prior art has included various attempts to curtail the cost and difficulty associated with the installation of complex or physically delicate communications systems. Such attempts have included various designs and methods for constructing enclosures to house the communications systems. Protecting the systems in this way makes them less vulnerable to difficulties and complications of the type that frequently arise in field construction and assembly of such systems. These designs and methodologies include those in which substantial portions of the assembly are completed in a more controlled environment such as a fabrication or assembly shop and the assembled portion shipped to the construction site for final installation.

With particular regard to communications systems, one improvement has been the use of turndown pads in connection with the assembly and installation of new or replacement communications systems. Specifically, a turndown pad was developed that would provide for the mechanical, electrical, and optical connection of various communications systems components. In particular, the turndown pads provided for connections between a digital loop carrier cabinet ("DLC cabinet") which provides digital telephone services, a "power pedestal" which connects the main power service to the DLC cabinet, and a "cross-connect panel" which connects the telephone service from the DLC to individual telephone customers. The turndown pad allowed the most complex and difficult interconnections between the DLC cabinet, the power pedestal, and the cross-connect panel to be installed inside the turndown pad at an assembly shop. The turndown pad was then delivered to the job site where it was mechanically joined with the DLC cabinet, the power pedestal, and the cross-connect panel. Thus, the only connections that were required in the field were the splices and cutovers that were required between the cabinets and the cutovers that were required with respect to inputs and outputs to the network.

One difficulty with the prior turndown pad system arose in part from the fact that there are a number of suppliers of the various cabinet components of the network, but there is no standardization for the dimensions and configurations of the various cabinets. This has meant that the electrical interconnections and the mechanical connections that are required to secure the cabinets to the turndown pad vary in accordance with the particular cabinets and combination of cabinets that are used at a particular installation. The diversity between cabinets is such that no standardized or universal connection has been developed in the prior art. The number and variety of available cabinets is sufficiently large that a great number of possible combinations of cabinets exist. This in turn has required that, to control inventory costs of the turndown pads, the turndown pads have been fabricated on a made to order basis.

Another difficulty with some prior turndown pads has been that they were fabricated out of concrete. Fabricating concrete turndown pads on a made to order basis has required significant fabrication time. The concrete forming process is relatively slow and is inherently limited by the rate at which the concrete will cure. Concrete turndown pads are also relatively heavy and therefor somewhat difficult and unsafe to transport and manipulate. Typically, such concrete turndown pads weigh approximately 22,000 pounds or more.

More recently, improvements were made by which the turn down pads could be prefabricated and assembled at a fabrication shop and thereafter transported to the installation site with the cabinets already mounted thereon. These improved turn down pads were made of composite materials such that they had strength and the rigidity sufficient to support the various cabinets, but also were lighter and more easily moved and manipulated than the concrete turndown pads that were known in the prior art. Also, these turndown pads could be assembled from pre-fabricated components such that the finally assembled turndown pad could be constructed more rapidly and with greater flexibility than the prior turndown pads.

These improvements greatly decreased construction time and cost for turndown pad fabricators and users, thereby also reducing the cost and installation time for the communication system. However, further improvements to the apparatus and methods for fabricating turndown pads whereby inventory requirements would be further controlled and simplified could further reduce costs and promote still further flexibility and responsiveness in the construction of the turndown pads.

SUMMARY OF THE INVENTION

In accordance with the subject invention, a system for assembling enclosures includes a deck panel sub-assembly that has a number of polygonal sides. The deck panel sub-assembly is constructed from a lateral array of panel members, each of the panel members having one longitudinal side with a tongue and an opposite longitudinal side with a groove, the tongue of one panel member engagingly received in the groove of an adjacent panel member. The system further includes a plurality of side-wall sub-assemblies that are also constructed of a lateral array of the panel members. One side-wall sub-assembly corresponds to a respective polygonal side of the deck panel sub-assembly and is connected to that respective side by a respective corner pultrusion member such that the deck panel sub-assembly and the side-wall sub-assembly cooperate to form an enclosure.

Preferably, at least one of the side-wall sub-assemblies is constructed of two or more lateral arrays of panel members that are arranged in parallel with respect to each other. Also preferably, the corner pultrusion member has two legs that are oriented substantially orthogonal with one of the legs defining two parallel slots that are each dimensioned to receive a side of one of the panel members.

The system further includes a mounting pultrusion that is connected to the side-wall sub-assembly at a side that is opposite from the corner pultrusion. The mounting pultrusion has a top surface that defines two parallel slots, both of which are dimensioned to receive the side of a panel member of the side-wall sub-assembly. The mounting pultrusion provides support for the enclosure that is formed by the deck panel sub-assembly and the side-wall sub-assemblies.

Preferably, a mounting pultrusion is also attached to an interior surface of the enclosure and used to support a panel member that acts as a truss to support the deck panel sub-assembly. The mounting pultrusion can also be attached to the interior of the side-wall sub-assembly and further connected to a panel member that is used as a brace to oppose hydrostatic pressure against the side-wall sub-assemblies.

Also preferably, the system can further include a portal trim member that has two fork members that define a slot that receives a side of panel members at the periphery of portals in the enclosure. The portal trim member has a base member that extends into the portal and provides a contact surface for hatches, doors and other closures.

In addition, the system can be used with an extension member that cooperates with the enclosure to form a pedestal. The pedestal is made of two units and can be transported by vehicles with fewer vehicle height limitations than would apply if the pedestal were a single unit.

Also in addition, the enclosure defined by the deck panel sub-assembly in combination with the side-wall sub-assemblies can be combined with a lateral array of panel members that form a floor that closes the open end of the enclosure.

Other features, objects and advantages of the subject invention will become apparent to those skilled in the art as a description of a presently preferred embodiment of the invention proceeds.

BRIEF DESCRIPTION OF THE DRAWINGS

A presently preferred embodiment of the invention is shown and described in connection with the accompanying drawings wherein.

PREFERRED EMBODIMENT OF THE INVENTION

Figure 1:
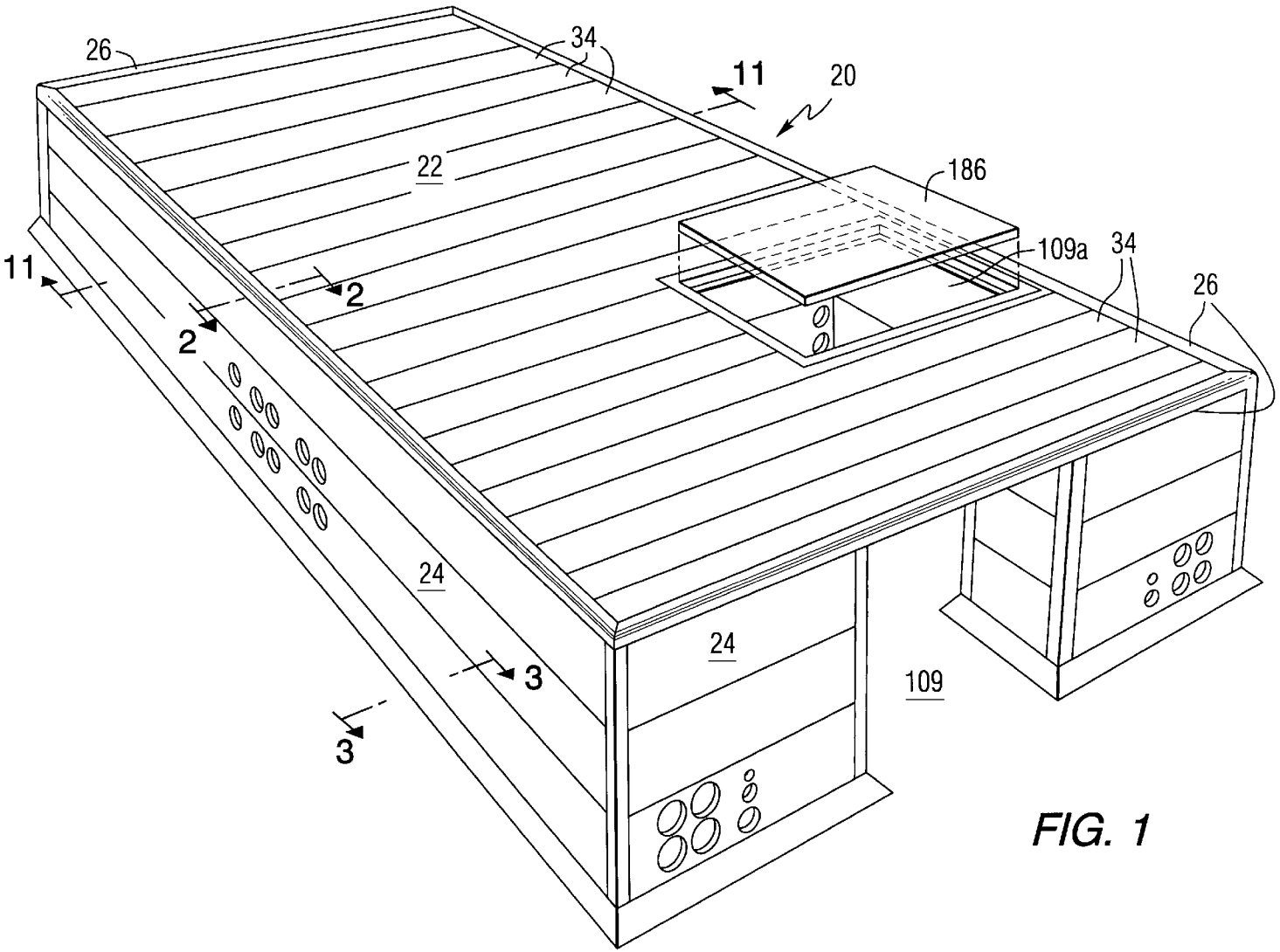
FIG. 1 is an assembly view of one embodiment of the turndown pad that is disclosed herein.
Figure 2:
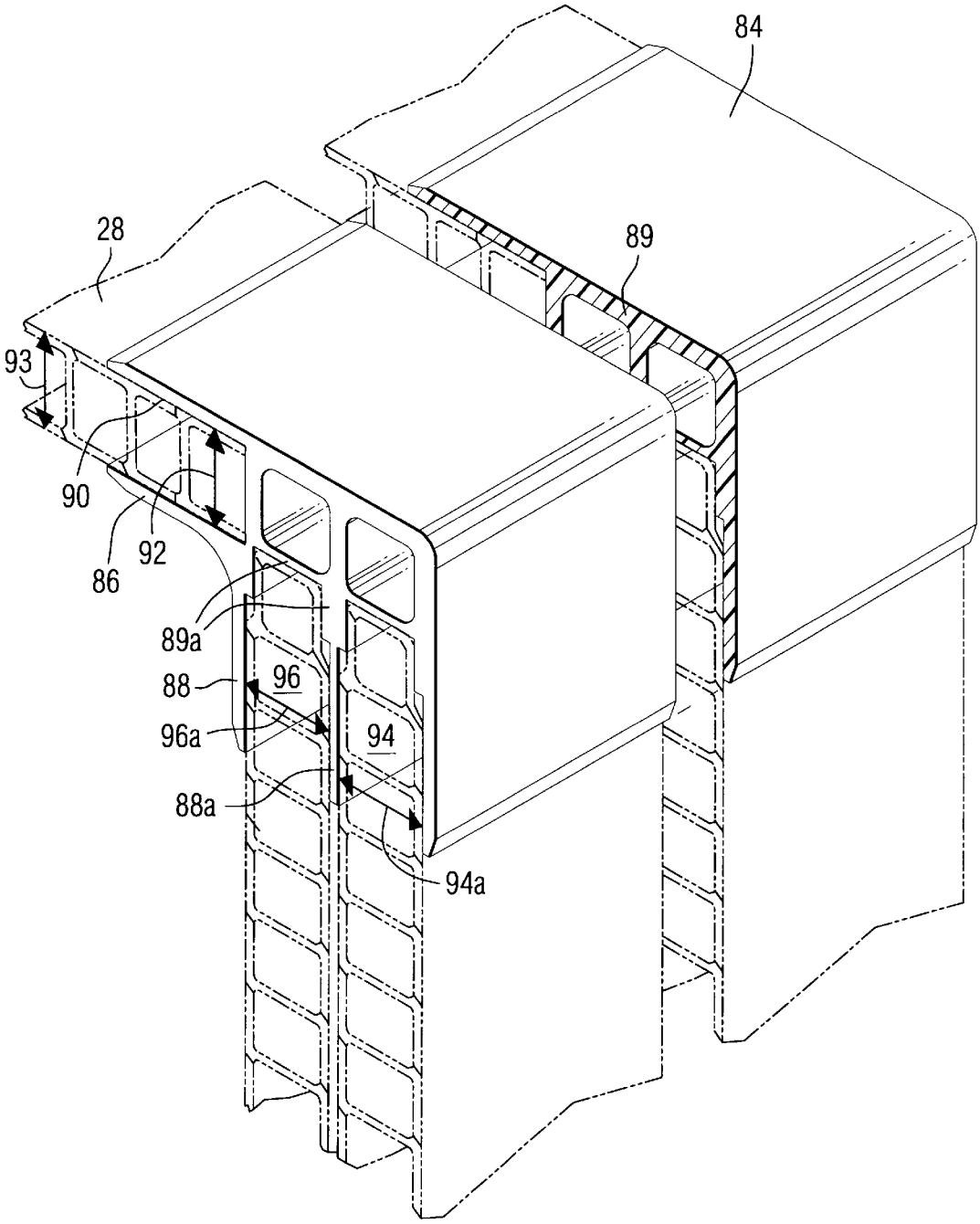
FIG. 2 is a partial cross-sectional view of the turndown pad shown in FIG. 1 taken along the lines 2—2 of FIG. 1.
Figure 3:
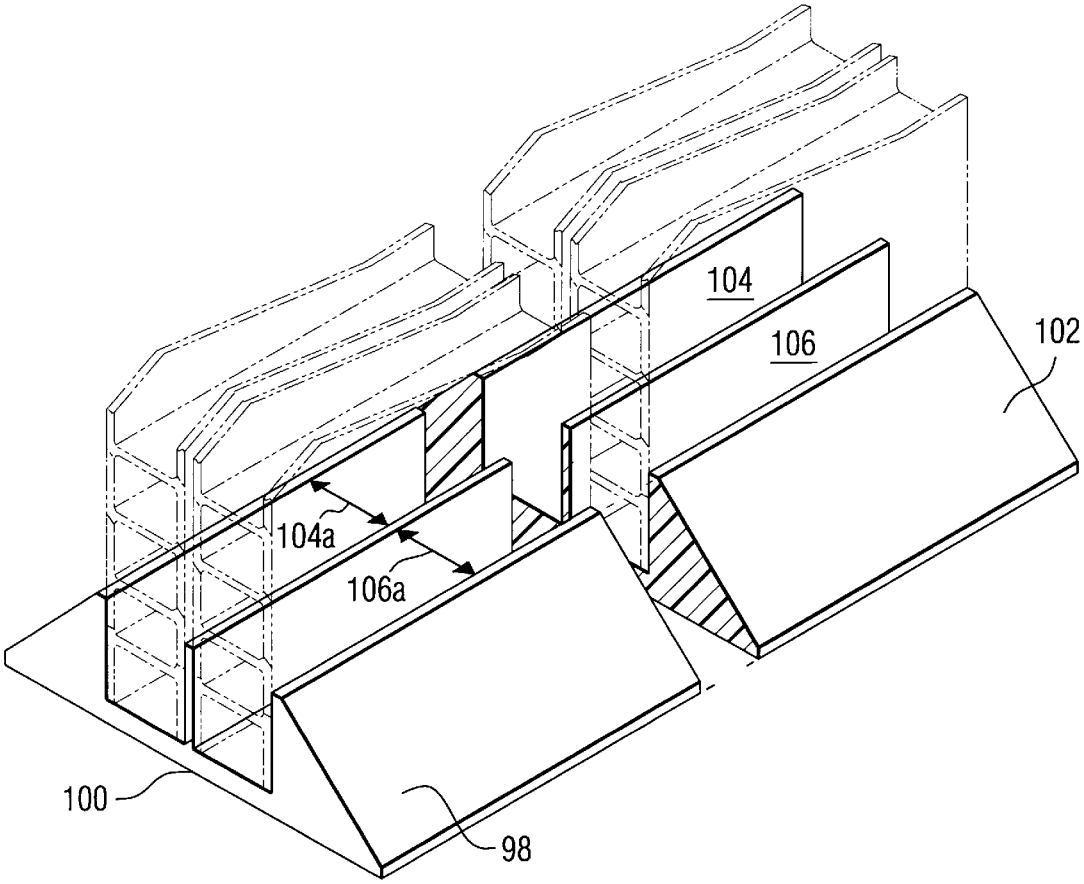
FIG. 3 is a partial cross-sectional view of the turndown pad shown in FIG. 1 taken along the lines 3—3 of FIG. 1.
Figure 4:
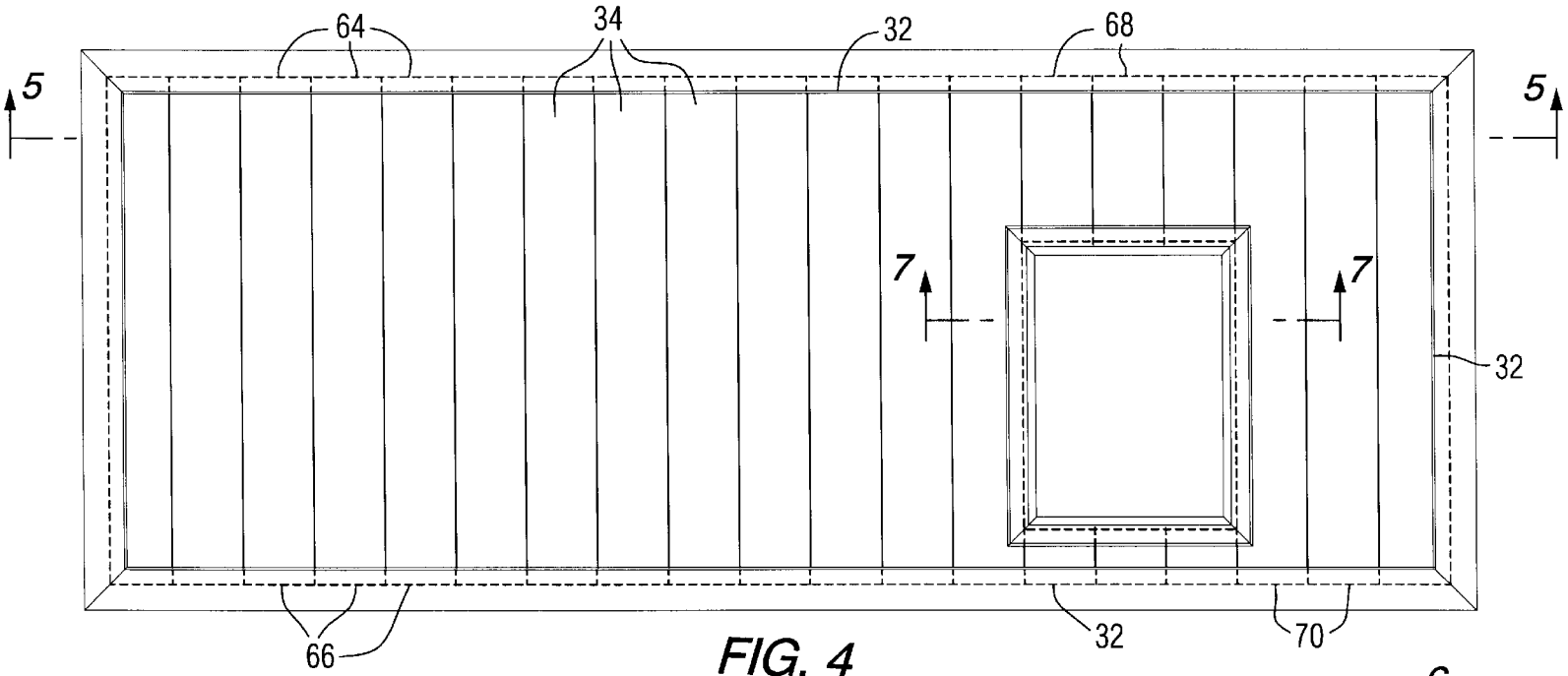
FIG. 4 is a top plan view of the turndown pad shown in FIG. 1.

As shown in FIGS. 1–7 and 11, a first preferred embodiment of a turndown pad 20 in accordance with the disclosed invention is constructed from three basic elements. Each of the three elements is designed such that they serve a plurality of applications and functions. In this way, the inventory requirements for the turndown pad fabricator are substantially reduced while, at the same time, the design options for the finally assembled turndown pad are substantially enhanced. This allows the turndown pad fabricator to construct a wide variety of turndown pad designs from a limited inventory of parts.

As shown in FIGS. 1–7 and 11, turndown pad 20 includes a deck panel sub-assembly 22 that is connected to a plurality of side-wall sub-assemblies 24 by corner pultrusion members 26. Deck panel sub-assembly 22 has an outer surface 28 and an interior surface 30 that cooperate to define a plurality of peripheral, polygonal edges 32 therebetween.

Figure 15:
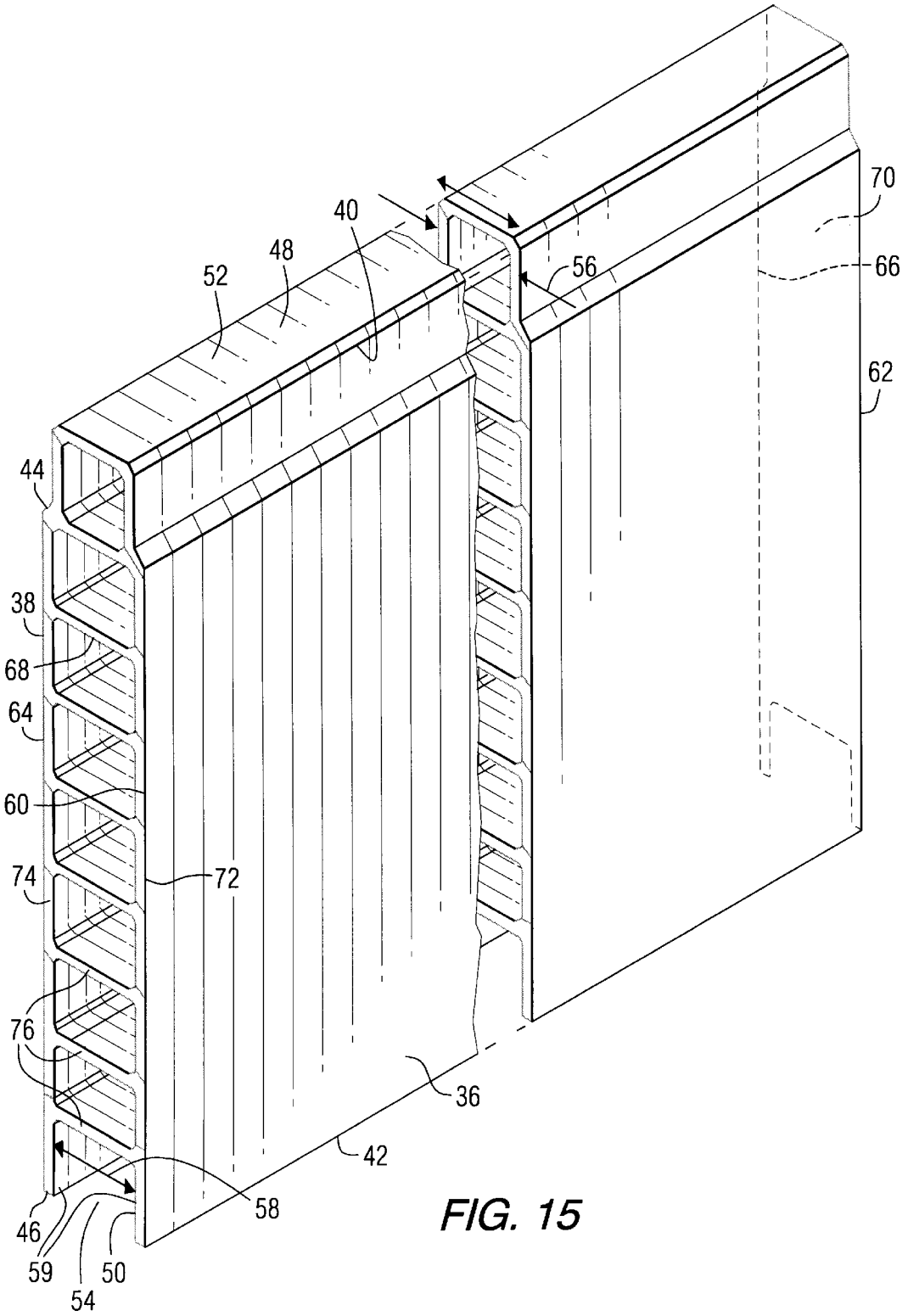
FIG. 15 is a projection of panel member that is used to construct the deck panel sub-assembly and the side-wall sub-assembly.

Deck panel subassembly 22 is constructed from a lateral array of panel members 34 that are more particularly shown in FIG. 15. Each of said panel members 34 has oppositely disposed planar surfaces 36 and 38 that are oriented in substantially parallel relationship with respect to each other. Planar surface 36 has first and second longitudinal edges 40 and 42 and planar surface 38 has first and second longitudinal edges 44 and 46. Longitudinal edges 40 and 44 cooperate to define a first longitudinal side 48 of panel member 34 therebetween. Similarly, longitudinal edges 42 and 46 cooperate to define a second longitudinal side 50 of panel member 34 therebetween.

As shown in the drawings, longitudinal side 48 of panel member 34 has an extending tongue 52 and longitudinal side 50 of panel member 34 has a groove 54. The width 56 of tongue 52 and the width 58 of groove 54 are compatibly dimensioned or sized such that tongue 52 of one panel member 34 can be received in groove 54 of a laterally adjacent panel member 34 and tongue 52 engages the sides 59 of groove 54 such that the panel members 34 are secured together.

As also shown in FIG. 15, planar surface 36 of panel member 34 has cross edges 60 and 62 and planar surface 38 of panel member 34 has cross edges 64 and 66. Cross-edges 60 and 64 cooperate to define an end 68 of panel member 34 therebetween. Cross-edges 62 and 66 cooperate to define an end 70 of panel member 34 therebetween.

Figure 11:
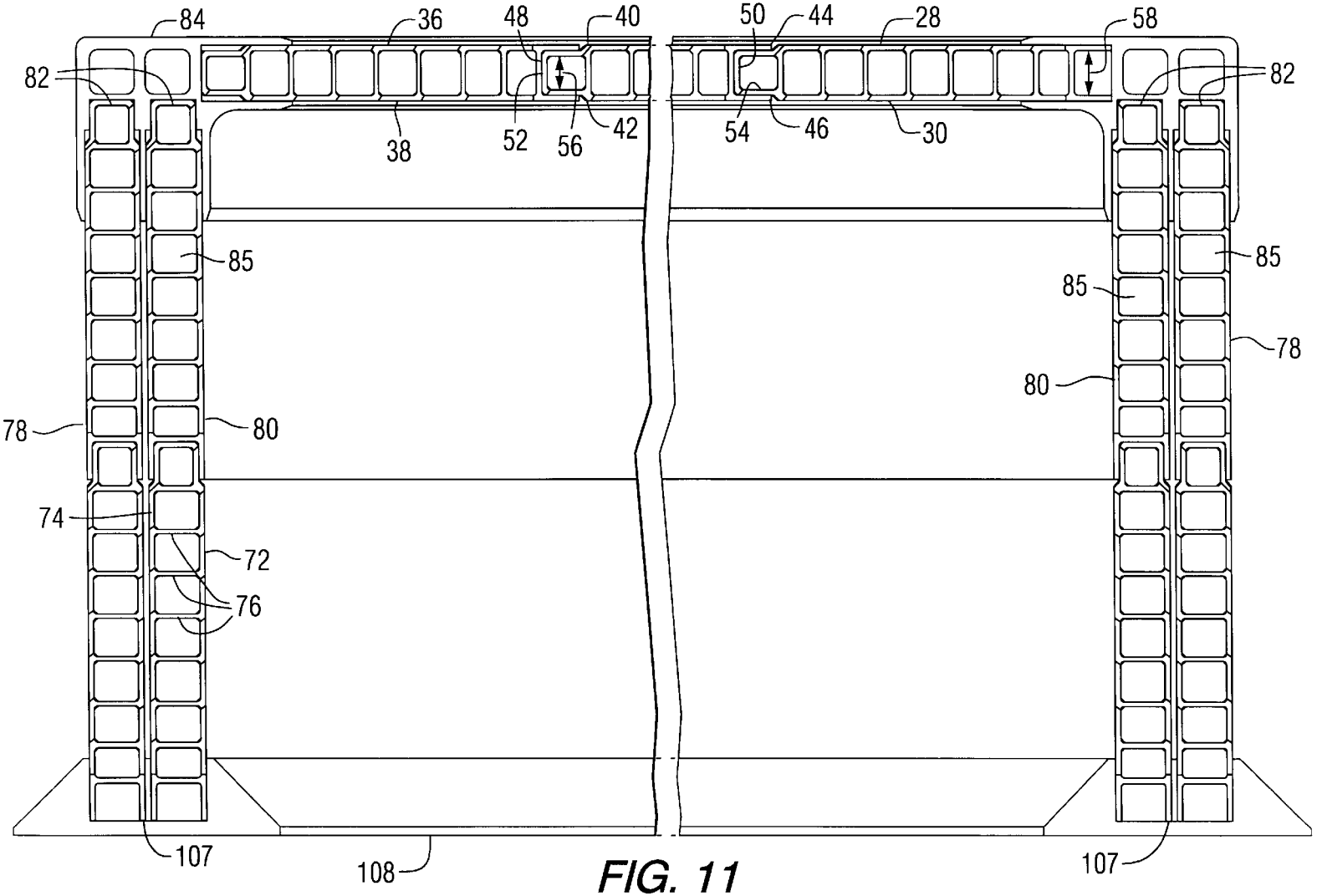
FIG. 11 is a cross-section of the turndown pad shown in FIGS. 1, 4 and 5 taken along the line 11—11 of FIG. 1.

As also shown in FIGS. 11 and 15, in the presently disclosed preferred embodiment, panel member 34 is comprised of first and second sheet members 72 and 74 respectively. Sheet members 72 and 74 are connected by a plurality of internal webs 76, although other embodiments of the invention will also become apparent to those skilled in the relevant art.

As also shown in FIGS. 1–7 and 11, sidewall sub-assemblies 24 each have an external surface 78 and an interior surface 80. Each of side-wall sub-assemblies 24 have an edge 82 that is defined between external surface 78 and interior surface 80 where edge 82 is of a length that is substantially equal to the length of a corresponding polygonal edge 32 of deck panel sub-assembly 22.

Each of the sidewall sub-assemblies 24 is constructed from a lateral array of panel members 34. As shown in the preferred embodiment, it is preferred that at least one of the side-wall sub-assemblies 24 are constructed of two side-wall panels 85, wherein each side-wall panel is a lateral array of panel members 34 and wherein the two side-wall panels 85 are arranged in combination in parallel or tandem relationship with respect to each other. It has been found that this arrangement of two parallel sidewall panels provides greater lateral strength that will support higher vertical loading on the sidewall subassembly 24. In many applications, it will be preferred that more than one side-wall subassembly 24 will be constructed of two parallel or tandem side-wall panels 85 such as shown in FIG. 11.

As further shown in the embodiment of FIGS. 1–7 and 11, deck panel subassembly 22 is connected to each of the respective sidewall sub-assemblies by a corner pultrusion member 26. One corner pultrusion member 26 corresponds to a respective one of each of the polygonal edges 32 of the deck panel sub-assembly 22. As more particularly shown in FIGS. 2 and 11, corner pultrusion members 26 have a first leg 86 and a second leg 88 with first leg 86 being oriented substantially orthogonal with respect to second leg 88. First leg 86 is connected to second leg 88 by a base 89. Preferably, base 89 is in the form of a tube that has a substantially square cross-section and that is further provided with internal webs 89*a*.

First leg 86 defines a slot 90 with slot 90 having a width 92 or lateral dimension that substantially corresponds to the thickness 93 of panel member 34 such that a panel member 34 can be engagingly received in slot 90. In this way, first leg 86 of corner pultrusion member 84 will engagingly receive deck panel sub-assembly 22, which is constructed of an array of panel members 34.

Second leg 88 of corner pultrusion member 84 defines two parallel slots 94 and 96. Similar to slot 90, slots 94 and 96 each have a width 94*a* and 96*a* or lateral dimension that substantially corresponds to the thickness 93 of panel member 34 such that slots 94 and 96 separately receive a panel member 34. In this way, second leg 88 of corner pultrusion member 84 will engagingly receive sidewall sub-assembly 24, which is constructed of one or two parallel side-wall panels 85 of panel members 34. Accordingly, corner pultrusion members 26 connect deck panel sub-assembly 22 to the side-wall sub-assemblies 24 such that deck panel sub-assembly 22 cooperates with sidewall sub-assemblies 24 to define an enclosure.

In addition, corner pultrusion members 26 can also be used to connect adjacent side-wall sub-assemblies 24 to form vertical corners of the pad 20

In addition to deck panel sub-assembly 22, side-wall sub-assembly 24, and corner pultrusion members 26, the turndown pad shown in FIGS. 1–7 and 11 further includes a mounting pultrusion 98. Mounting pultrusion 98 has a base surface 100 and a top surface 102 that is oppositely disposed on mounting pultrusion 98 from base surface 100. Top surface 102 defines two parallel slots 104 and 106 with each of slots 104 and 106 having a width 104*a* and 106*a* or lateral dimension that substantially corresponds to the thickness 93 of panel member 34 such that slots 104 and 106 engagingly receive an edge of a panel member 34. In this way, slots 104 and 106 can receive at least one of the side-wall panels 85 of the sidewall sub-assemblies 24, side-wall panels 85 being constructed of a lateral array of panel members 34.

In an alternative embodiment, preferably, the top surface 102 of mounting pultrusion 98 includes three divider walls that are oriented longitudinally in a slot and that are parallel with respect to each other such that said divider walls cooperate with the side-walls of the slot to define four parallel grooves. The four parallel grooves are dimensioned in lateral cross-section such that any two adjacent grooves receive the edge of a panel member 34.

As shown in FIGS. 1–7 and 11, mounting pultrusion 98 engagingly receives the side 107 of a side-wall sub-assembly 24 that is disposed oppositely from the edge 82 of the side-wall sub-assembly 24 that is connected to the corner pultrusion 26. In this way, mounting pultrusion 98 cooperates with the side-wall sub-assembly 24 to provide support for the enclosure that is defined by the deck panel sub-assembly 22 and the side-wall sub-assemblies 24.

Figure 5:
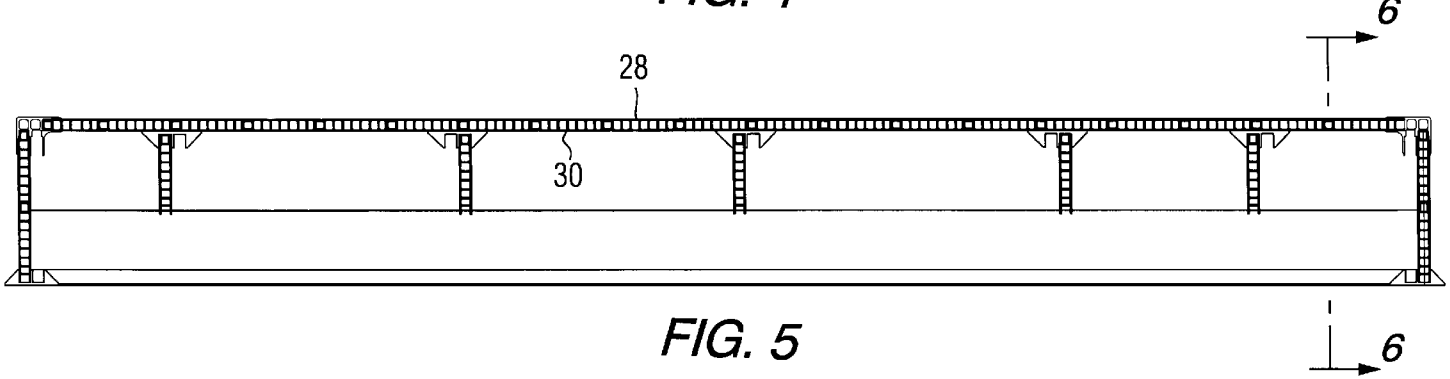
FIG. 5 is a cross-section of the turndown pad that is shown in FIGS. 1 and 4 taken along the line 5—5 of FIG. 4.
Figure 6:
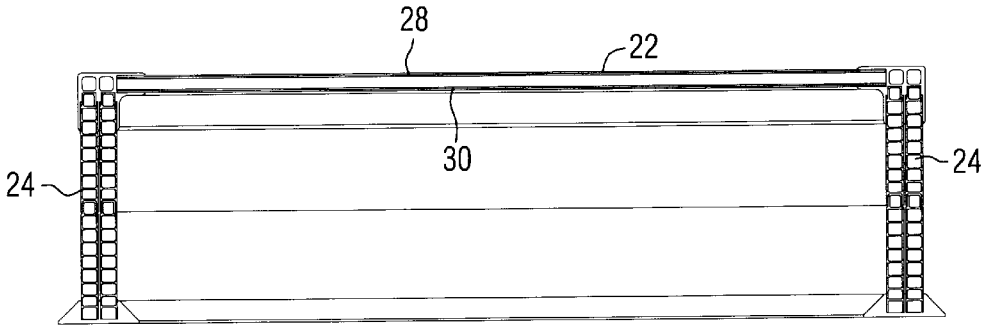
FIG. 6 is a cross-sectional view of the turndown pad shown in FIGS. 1, 4 and 5 taken along the line 6—6 of FIG. 5.

As more particularly shown in FIG. 5, mounting pultrusion 98 can also have other applications in the construction of the turndown pad. In FIG. 5, mounting pultrusion 98 is secured to the interior surface 30 of deck panel subassembly 22 by means such as an adhesive compound. A panel member 34 is then inserted into the slot 104 or 106 of mounting pultrusion 98 and also secured with an adhesive compound. In this way, mounting pultrusion 98 and panel 34 cooperate to form a truss that provides vertical support for the deck panel sub-assembly 22.

As a further modification of the truss that is shown in FIG. 5, additional mounting pultrusions 98 can be secured to the internal surfaces 80 of side-wall sub-assemblies 24. Such additional mounting pultrusions 98 are located such that one of slots 104 or 106 receive an end of the panel member 34 that is a truss. In this way, the panel members 34 that are trusses are further secured to the interior of the turndown pad.

Figure 8:
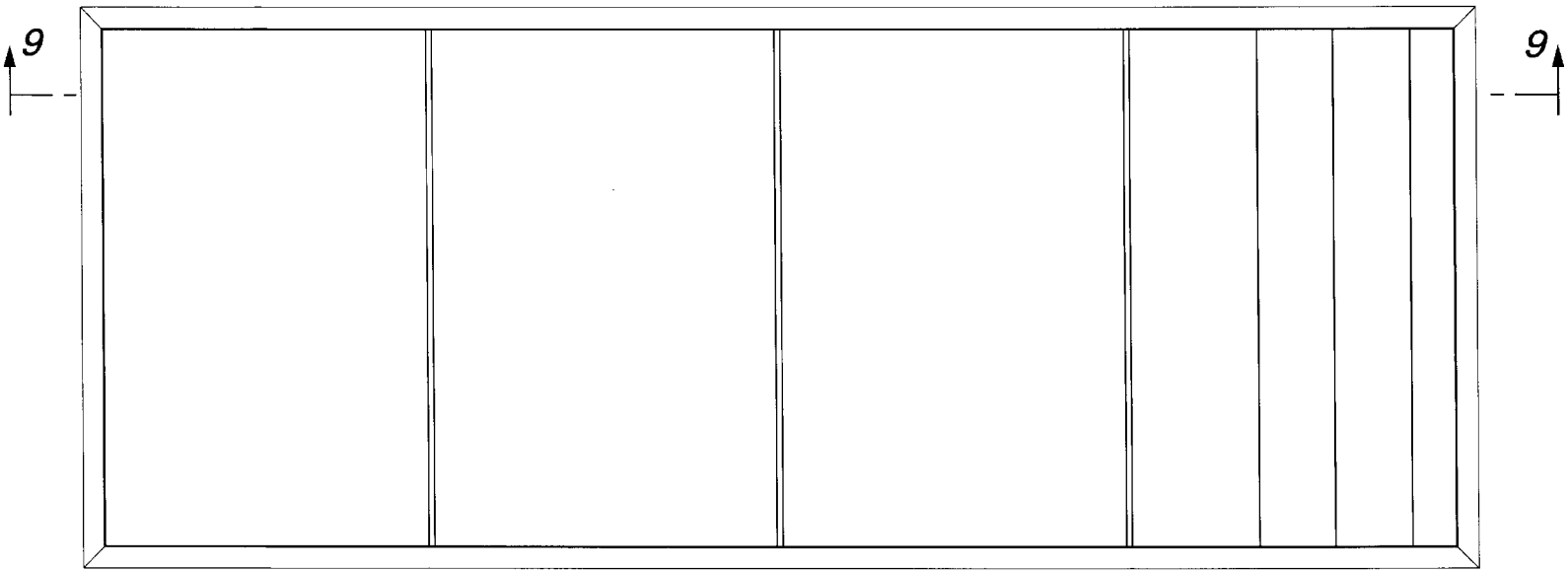
FIG. 8 is a top view of an extension that is used in combination with the turndown pad shown in FIGS. 1, 4, and 5 with a partial deck panel and bottom braces therein.
Figure 9:
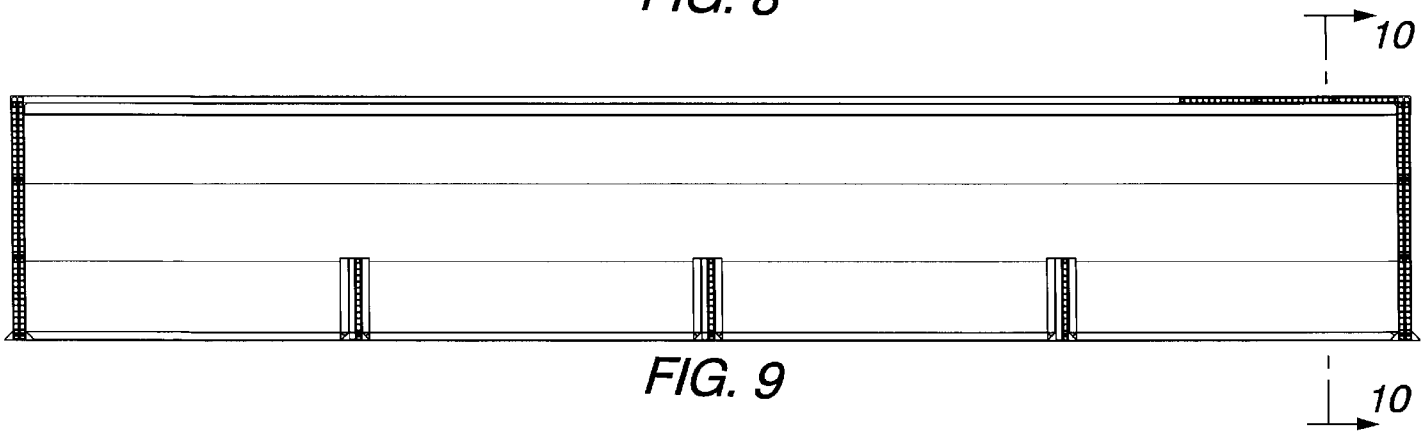
FIG. 9 is a cross-section of the turndown pad shown in FIG. 8 taken along the lines 9—9 of FIG. 8.
Figure 13:
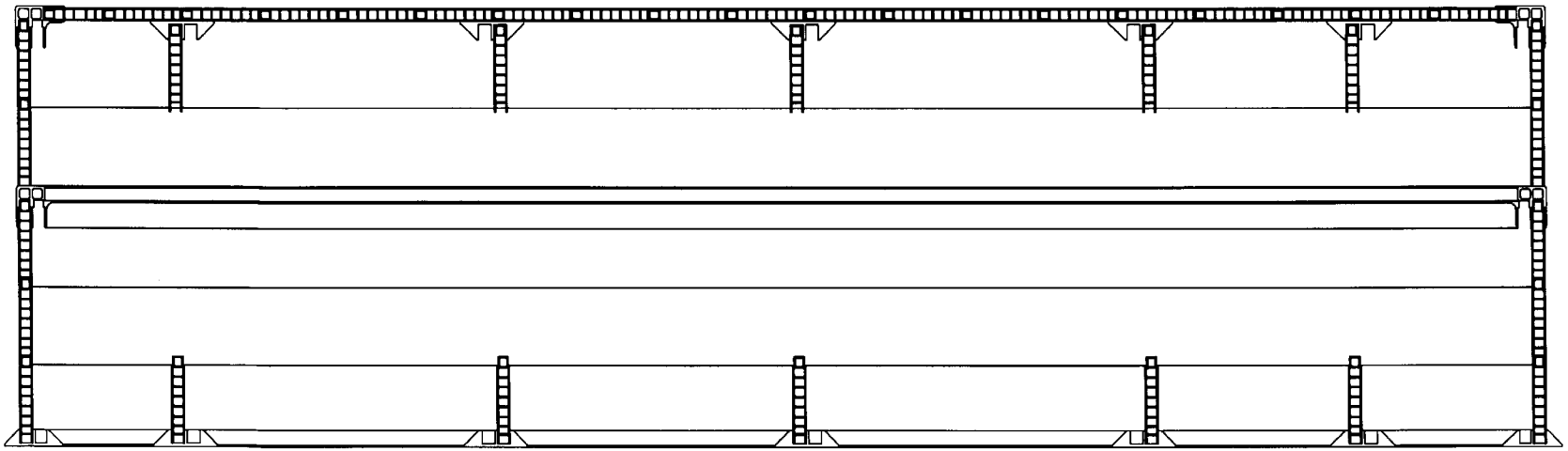
FIG. 13 is a cross-section of the turndown pad shown in FIGS. 1–4 in combination with the extension shown in FIGS. 8, 9 and 10.

Still other alternative embodiments of the subject invention are disclosed in FIGS. 8, 9 and 13. In certain applications, the extension 120 is installed in subterranean applications wherein lateral forces are applied to the side-wall sub-assemblies as the result of hydrostatic pressure. To maintain the side-wall sub-assemblies 122 against these lateral hydrostatic forces, an alternative embodiment is shown in FIGS. 8 and 9 wherein mounting pultrusions 98 are secured to the internal surfaces 124 of sidewall sub-assemblies 122. Such additional mounting pultrusions are located such that one of slots 104 or 106 receive an end of a panel member 34 such that the panel member 34 acts as a brace against hydrostatic pressure on the side-wall subassembly 124. In this way, the panel members 34 serve as braces that are secured to the interior of the extension 120. It will be apparent from the foregoing description that panel member 34 and mounting pultrusions 98 could also be used in an equivalent manner to form braces for side-wall sub-assemblies 24 of pad 20 in applications where this was necessary.

While a particular design of a turndown pad is shown and described herein, the specific designs of turndown pads of the various assemblers differ widely. For example, some are generally rectangular while others tend to be substantially square. Many of the turndown pads have hatchways, doors of other access portals at various locations depending on the specific design the manufacturer and the requirements of the particular application for which the turndown pad is being constructed. The example of the preferred embodiment of FIGS. 1 and 4 includes a "doghouse" 109.

Figure 7:
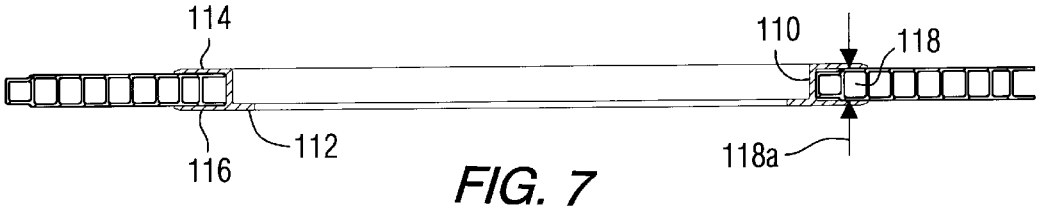
FIG. 7 is a partial cross-section of the turndown pad shown in FIGS. 1 and 4, taken along the lines 7—7 of FIG. 4.
Figure 10:
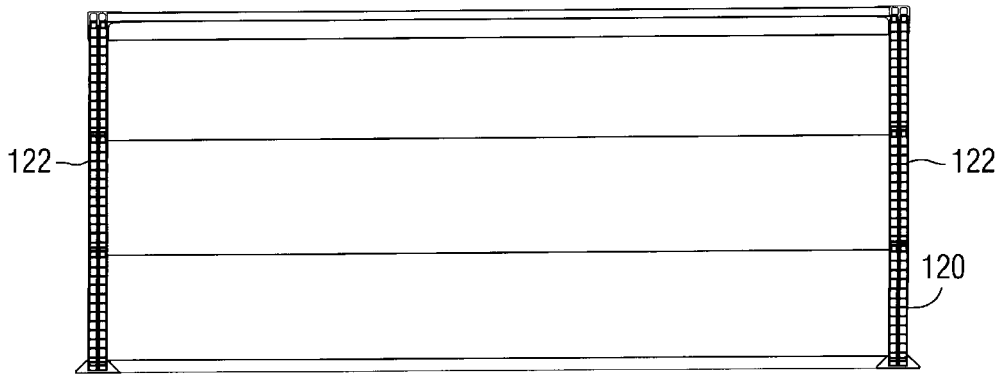
FIG. 10 is a cross-section of the extension shown in FIGS. 8 and 9 taken along the lines 10—10 of FIG. 9.

As more specifically shown in FIG. 7, where a particular design of the turndown pad requires an entrance portal such as a door or a hatchway 109*a*, the preferred embodiment further comprises a portal trim member 110 that provides a contact or stop surface for hatch covers and doors. Portal trim member 110 has a base member 112 that is in the general shape of rectangular bar and fork members 114 and 116 that are connected to base member 112 along a longitudinal edge of base member 112. Fork members 114 and 116 define a space therebetween with the space being in the general form of a slot 118. The width 118*a* of slot 118 is substantially the same as the width 93 of a panel member 34 such that slot 118 will engagingly receive the side of a panel member 34. Slot 118 engages the sides of panel member 34 that define the perimeter of portals in the turndown pad 20 and base member 112 extends as a flange into the portal to provide a contact surface or stop for the hatch cover 118*b* or door.

As apparent from the forgoing description of the presently preferred embodiment of the invention, deck panel sub-assembly 22 and side-wall sub-assembly 26 are constructed from a lateral array of panel members 34 that are more particularly shown in FIG. 15. The common use of panel members 34 in deck panel sub-assembly 22 and side-wall subassembly 24 allow the turndown pad that is herein disclosed to be constructed of only three basic elements: the panel member 34, the corner pultrusion members 26, and the mounting pultrusions 98. In addition, the portal trim member 110 is also frequently used where the turndown pad design requires hatchways or other access portals.

FIGS. 8, 10, 12 and 13 show a further preferred embodiment of the presently disclosed invention wherein an extension 120 can be used in cooperation with the turndown pad shown in FIGS. 1–7 and 11. Extension 120 includes side-wall sub-assemblies 122 that are constructed from lateral arrays of panel members 34 in substantially to the same manner as sidewall sub-assemblies 24. Extension 120 has a plurality of side-wall sub-assemblies 122 with one of each of said sidewall sub-assemblies 122 corresponding to a respective one of the polygonal edges 32 of deck panel sub-assembly 22. However, extension 120 has no deck panel sub-assembly 22 such as described in connection with the turndown pad of FIGS. 1–7. Extension 120 is dimensioned such that the side-walls 122 correspond with the side-walls 24 of the turndown pad with which extension 120 is intended to be used. In this way extension 120 defines an internal polygonal shape that corresponds to the shape and dimensions of the deck panel sub-assembly 22 of the turndown pad. Extension 120 has a mounting pultrusion 98 at the base thereof, but the mounting pultrusion 98 that forms the base of the turndown pad shown and described in FIGS. 1–7 is removed.

Figure 12:
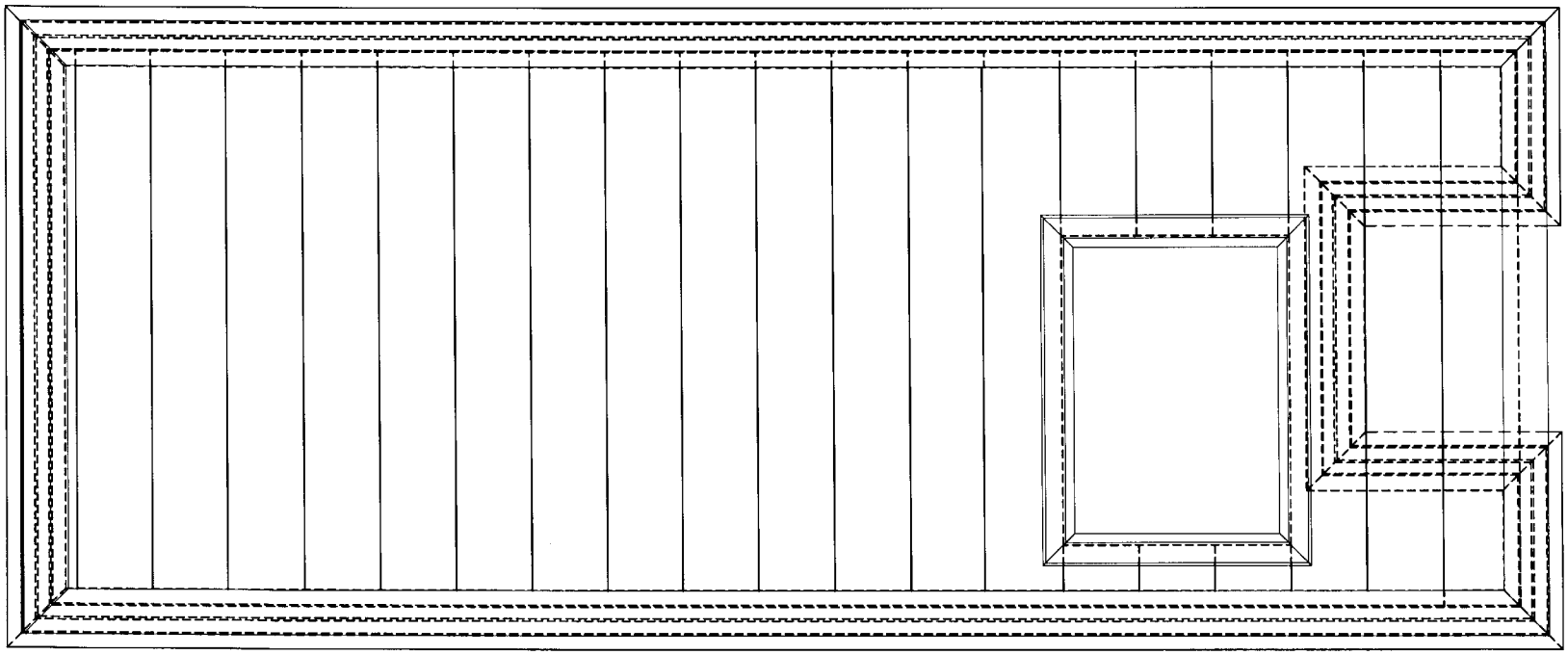
FIG. 12 is top plan view of the turndown pad shown in FIGS. 1, 4 and 5 with internal portions thereof shown in hidden lines.

The use of this embodiment is illustrated in FIGS. 12 and 13 wherein, the turndown pad 20 and the extension 120 are transported to the installation site and assembled there to form a pedestal. Extension 120 is first placed on a site where the turndown pad 20 is to be located. The turndown pad is then lowered onto the top of extension 120. Since the sidewall sub-assemblies 122 of extension 120 are dimensioned to coincide with the sidewall sub-assemblies 24 of the turndown pad, when the turndown pad is placed on top of the extension, the bottom edge of the sidewall sub-assemblies 24 engage the top of the respective sidewall sub-assemblies 122 and the extension 120 vertically supports the turndown pad. Side-wall sub-assemblies 24 and 122 are fastened together by means of guide pins and bolts or other fastener means. In this way, a turndown pad, with increased vertical height, is provided to the installation site.

An important advantage of this construction is to allow the assembled turndown pad 20 to be transported to the construction site on the same vehicle as the extension 120 while still meeting common height restrictions for the transportation vehicle. More specifically, the turndown pad is placed on the transportation vehicle for shipment to the installation site. Then the extension 120 is placed on top of the turndown pad. The height for this assemblage during transport is less than the overall height of the finally assembled turndown pad 20 as supported by the extension 120 because, while being transported, the extension 120 surrounds the cabinets that are mounted on the turndown pad 20. Thus, transporting extension 120 with turndown pad 20 creates essentially no additional clearance requirement to avoid road obstructions such as overpasses, bridges, electrical wires and the like.

Figure 14:
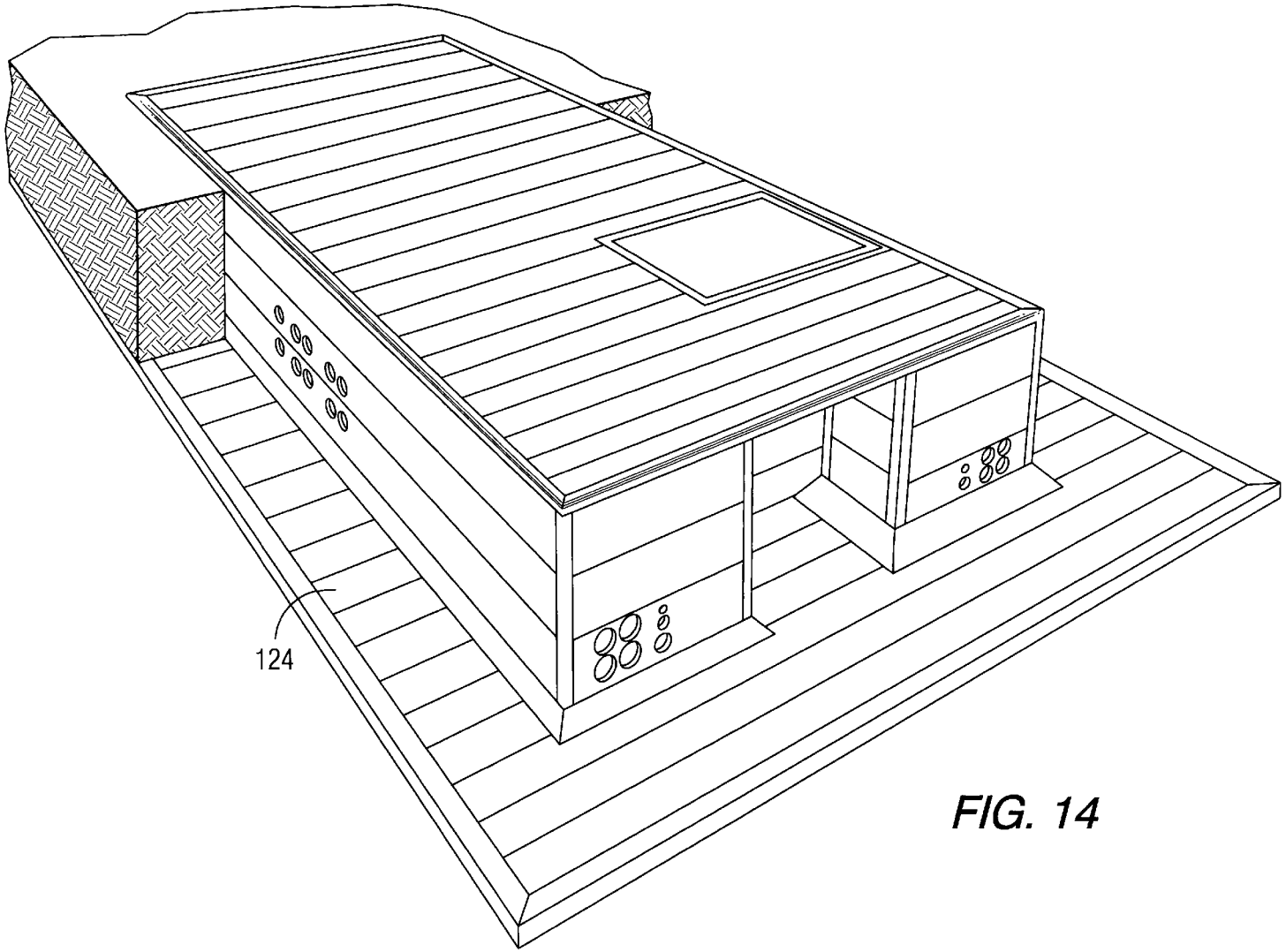
FIG. 14 is another alternative embodiment of the turndown pad shown in FIGS. 1 and 4 in combination with a platform anchor.

Still another preferred embodiment of the disclosed invention is shown in FIG. 14 wherein a turndown pad such as the one shown and described in connection with FIGS. 1–7 is further connected to a platform anchor 124. The platform anchor 124 is comprised of a lateral array of panel members 34. The panel members 34 of the platform anchor 124 can be framed by corner pultrusion members 26, but this is not essential to the disclosed invention. The platform anchor 124 is secured to the turndown pad 20 by adhesive material or rivets or equivalent fasteners.

Figure 16:
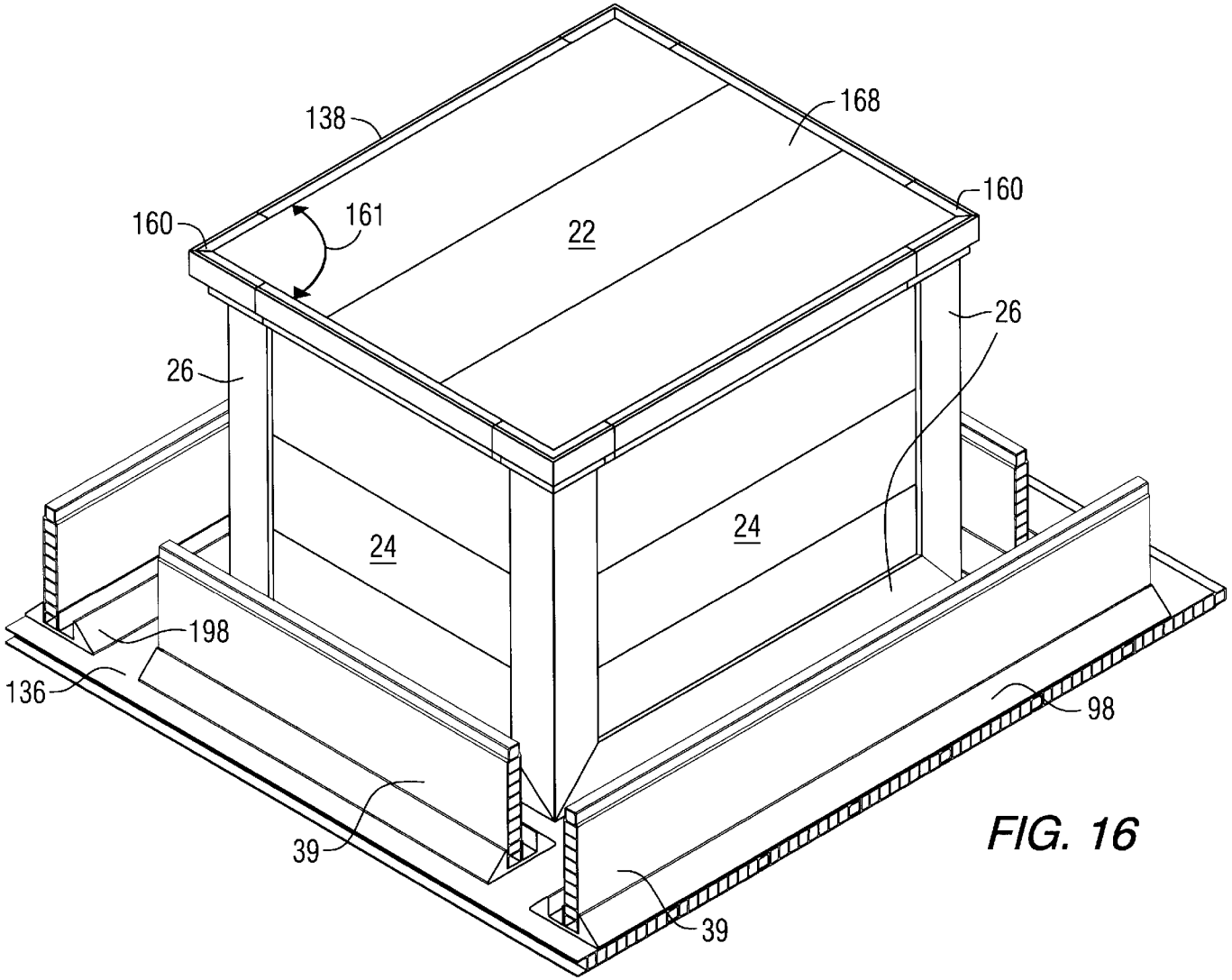
FIG. 16 is an assembly drawing of an alternative embodiment of the presently disclosed invention wherein an enclosure is combined with a floor panel to provide a totally enclosed structure.
Figure 17:
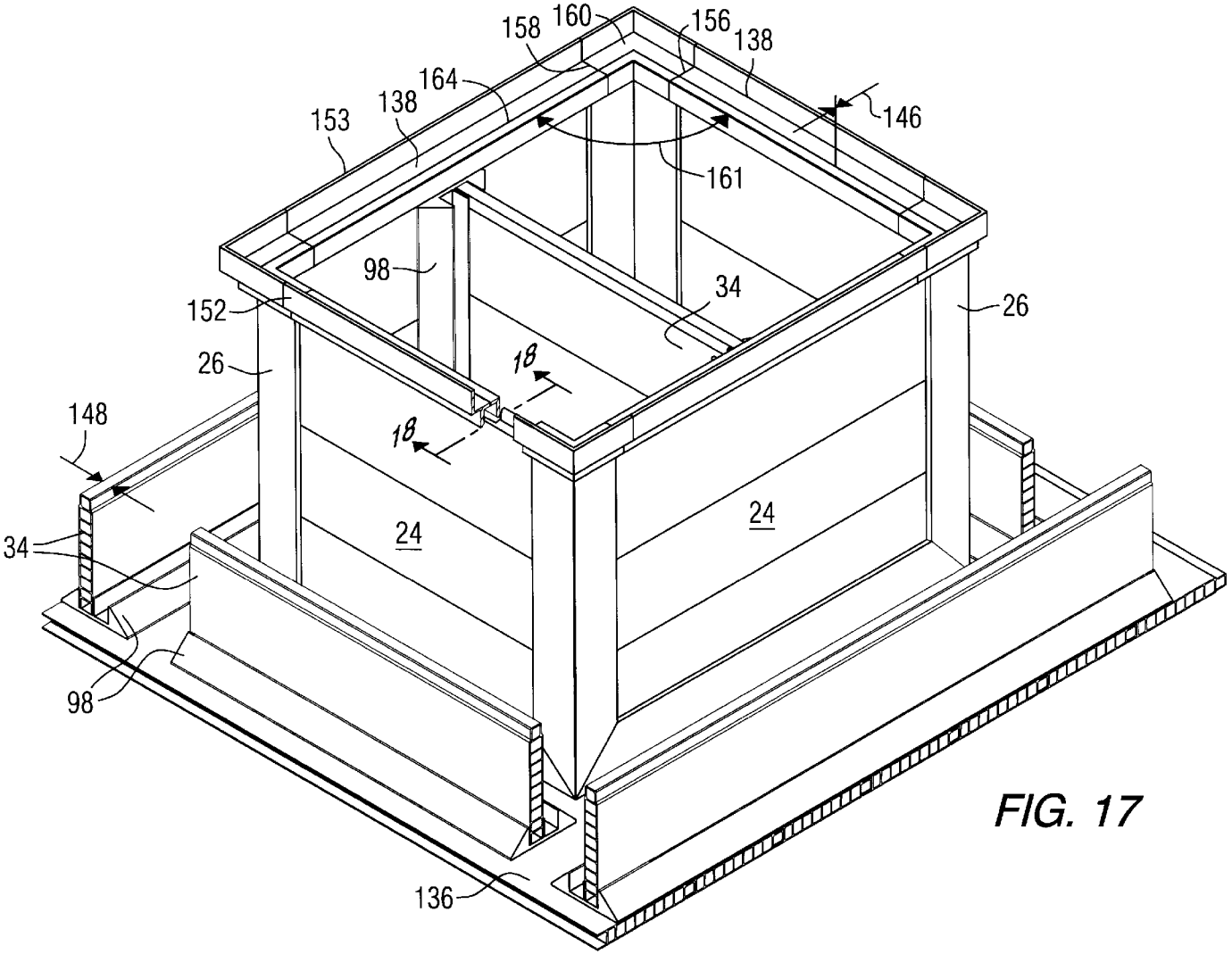
FIG. 17 is a partial view of the totally enclosed structure shown in FIG. 16 with the deck panel sub-assembly removed and with portions of the side cap broken away.
Figure 18:
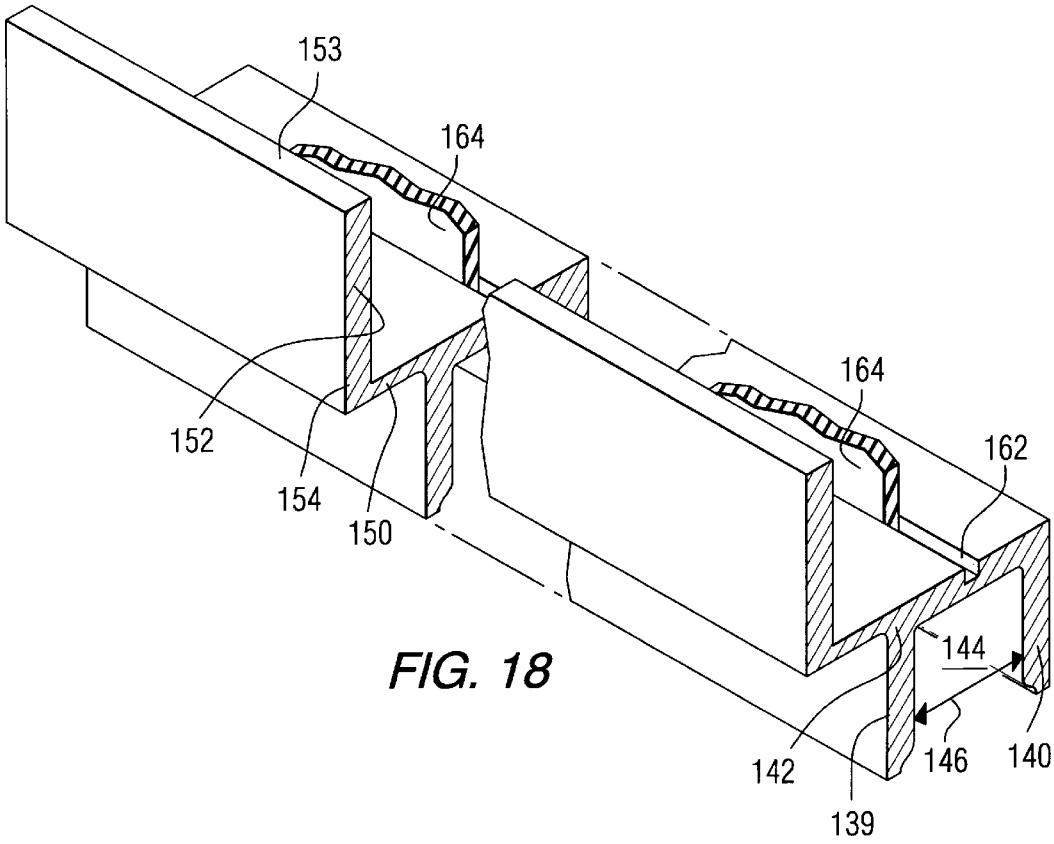
FIG. 18 is a cross section of the side cap shown in 16 and 17 taken along the lines 18—18 of FIG. 17.

As shown in FIGS. 16 and 17, the presently disclosed invention includes a further modification wherein a floor panel 136 is constructed of a lateral array of panel members 34. In the embodiment of FIGS. 16 and 17, a deck panel sub-assembly 22 cooperates with a plurality of side-wall sub-assemblies 24 to form an enclosure. However, in this embodiment, deck panel sub-assembly 22 is not connected to the sidewall sub-assemblies 24 by corner pultrusion members 26. Instead, the top edges 82 of side-wall sub-assemblies are provided with a respective side cap 138.

Side cap 138 includes fingers 139 and 140 that are connected to a base 142. Fingers 139 and 140 are spaced apart to define a slot 144 therebetween. The width 146 of slot 144 is substantially equal the width 148 of tongue 52 of panel member 34 such that tongue 52 of panel member 34 is engagingly received in slot 144. Base 142 of side cap 138 includes an offset portion 150 having a riser panel 152 that vertically extends from the distal end 154 of offset portion 150. Rise panel 152 has a top surface 153.

A side cap 138 corresponds to each of the respective side-wall sub-assemblies 24 with opposing ends 156 and 158 of adjacent side caps 138 being connected by a corner side cap 160. Corner side cap 160 is of substantially the same cross-section as side cap 138 with like members being ascribed the same reference characters as side cap 138. Corner side cap 160 further includes an included angle 161 in that corresponds to the angle between the adjacent side-wall sub-assemblies 24. In the example of the included embodiment, the included angle is 90 degrees.

The base 142 of side caps 138 and corner side caps 160 further includes a notch 162 in the top surface of base 142 and a gasket 164 that is maintained in notch 162. The riser panel 152 of a selected one of the side caps 138 is connected to one of the polygonal sides of deck panel sub-assembly 22 by a compound hinge 166 of a type that is commercially available and known in the art. This allows the deck panel sub-assembly 22 to be swung open to provide access to the interior of the enclosure and to be closed to provide a total enclosure. When the deck panel sub-assembly is closed, it engages gasket 164 to provide a seal between deck panel sub-assembly 22 and side caps 138 and corner side caps 160. Also, when the deck panel sub-assembly is closed, the compound hinge is not exposed and top surface 153 of the riser panels 152 are in substantially the same plane as the outside surface of the top deck sub-assembly 22.

In a manner similar to the enclosure described in connection with the other embodiments, the number of side-wall sub-assemblies 24 corresponds to the number of polygonal sides 32 of deck panel sub-assembly 22. Side-wall sub-assemblies 24 are connected at their vertically adjoining sides by corner pultrusion members 26. In addition, the lower edge 107 of each side-wall sub-assembly 24 is connected to a respective corner pultrusion member 26.

To secure the enclosure formed by deck panel sub-assembly 22 and side-wall sub-assemblies 24, the corner pultrusion members 26 that are connected to the lower edge 107 of each side-wall 24 are secured to floor panel 136 by an adhesive and rivets or other fasteners. To oppose bending moments against floor panel 136, floor panel 136 is further provided with at least one mounting pultrusion member in combination with a panel member 34. In the example of FIGS. 16 and 17, four such combinations are provided although a fewer or greater number of such combinations could also be used depending on the requirements of the particular installation. For each combination the base surface 100 of the mounting pultrusion member 98 is secured to the floor panel 136 by adhesive or other means and the panel member 34 is engagingly received in the slot 104 or 106 of the mounting pultrusion 98. This combination mounting pultrusions 98 and panels 34 substantially increases the rigidity of floor panel 136 so that it is more resistive to bending moments.

As will be apparent to those skilled in the art, the enclosure shown in FIGS. 16 and 17 provides an "at grade" enclosure which is substantially under ground except for the deck panel sub-assembly 22 which is flush to grade. To provide a convenient concrete pad around the top panel sub-assembly, the riser panels 152 of the side caps 138 and corner side caps 160 cooperate to provide a form against which the concrete can be poured.

As particularly shown in FIG. 17, mounting pultrusion members 98 can be secured to the internal surface of side-wall sub-assemblies 24 with the base surface 100 being secured by an adhesive or other means. The mounting pultrusions are located on the internal surface such that the slots 104 or 106 in the upper surface 102 thereof receive the end portions of a panel member 34. In this way, panel member 34 cooperates with the mounting pultrusions 98 to provide a brace that opposes lateral forces due to hydrostatic pressure against side-wall sub-assemblies 24.

While several presently preferred embodiments of the presently disclosed invention and several presently preferred methods of practicing the same are shown and described herein, it will be apparent to those skilled in the art that the invention can be otherwise variously embodied within the scope of the following claims.

What is claimed is:

1. An enclosure system for assembling enclosures from multipurpose components, said system comprising:

a deck panel sub-assembly that defines a plurality of polygonal edges, said deck panel sub-assembly being constructed from a lateral array of panel members, each of said panel members having a first longitudinal side that includes an extending tongue and a second longitudinal side that includes a groove, the tongue of the first longitudinal side being dimensioned with respect to the groove of the second longitudinal side such that the tongue of one panel member is engagingly received in the groove of a laterally adjacent panel member;

a plurality of side-wall sub-assemblies, one of each of said side-wall sub-assemblies corresponding to a respective one of the polygonal edges of said deck panel sub-assembly, each of said side-wall sub-assemblies being constructed of a lateral array of said panel members;

a plurality of corner pultrusion members one of each of said corner pultrusion member corresponding to a respective one of the polygonal edges of said deck panel sub-assembly, each of said corner pultrusion members having first and second legs that are oriented substantially orthogonal with respect to each other, each of said first and second legs defining a slot that is laterally dimensioned to receive a side of said panel member, said corner pultrusions connecting one polygonal side edge of the deck panel sub-assembly to one of said side-wall sub-assemblies such that said deck panel sub-assembly cooperates with said side wall sub-assemblies to define an enclosure; and a mounting pultrusion member that has a base surface and a top surface that is oppositely disposed from the base surface, the top surface of said mounting pultrusion defining at least one slot that is dimensioned to receive an edge of a panel member, said mounting pultrusion receiving at least one side-wall sub-assembly and cooperating with said side-wall sub-assembly to provide support for the enclosure that is defined by the deck panel sub-assembly and the sidewall sub-assemblies.

2. The enclosure system of claim 1 including at least one additional mounting pultrusion member wherein the base surface of the mounting pultrusion member is connected to the interior surface of the deck panel sub-assembly and at least one panel member is received in the slot that is defined by the top surface of the additional mounting pultrusion member such that said panel member operates as a truss to provide vertical support to the deck panel sub-assembly.

3. The enclosure system of claim 2 wherein a second additional mounting pultrusion member has a base surface that is connected to the interior surface of one of said side-wall sub-assemblies and the slot that is defined in the top surface of the second additional mounting pultrusion member receives one end of the panel member that operates as a truss to provide vertical support to the deck panel sub-assembly.

4. The system of claim 3 further comprising two or more mounting pultrusion members with the base of each of said mounting pultrusion members being secured to the interior surface of a respective one of said side-wall sub-assemblies; and at least one panel member with each end of the panel member being received in a respective one of the two or more mounting pultrusion members to provide lateral support for the side-wall sub-assemblies.

5. The system of claim 1 wherein the enclosure includes assess portals therein where said access portals are provided with closures, said system further comprising:

a portal trim member having a base member that is in the general shape of a rectangular bar and also have first and second fork members that extend from one longitudinal edge of the rectangular base member, said fork members being spaced apart to define a slot therebetween, said slot being dimensioned to receive a side of the panel member, the slot of said portal trim member engaging the sides of the panel members that define the perimeter of a portal in said enclosure with said base member extending into said portal to provide a contact surface at the perimeter of said portal, said contact surface cooperating with the closures for said portals.

6. The system of claim 1 further comprising:

an extension member, said extension member having a plurality of side-wall sub-assemblies, one of each of said side-wall sub-assemblies corresponding to a respective one of the polygonal edges of said deck panel sub-assembly, each of said side-wall sub-assemblies being constructed of a lateral array of said panel members, said extension defining a internal polygonal shape that corresponds to the shape and dimensions of the polygonal shape that is defined by the sidewalls of the enclosure, said extension being joined with the side-wall sub-assemblies of the enclosure to provide an enclosure of extended vertical height.

7. A system for assembling enclosures from multi-purpose components, said system comprising:

a deck panel sub-assembly that defines a plurality of polygonal edges, said deck panel sub-assembly being constructed from a lateral array of panel members, each of said panel members having oppositely disposed planar surfaces that are substantially parallel with respect to each other, said planar surfaces each having first and second longitudinal edges that cooperate to define first and second longitudinal sides of the panel member, each of said planar surfaces also having first and second cross-edges that cooperate respectively to define first and second ends of the panel member, the first longitudinal side of said panel member having an extending tongue and the second longitudinal side of said panel member defining a groove;

a plurality of side-wall sub-assemblies, one of each of said side-wall sub-assemblies corresponding to a respective one of the polygonal edges of said deck panel sub-assembly, each of said side-wall sub-assemblies being constructed of a lateral array of said panel members and at least one of said side-wall sub-assemblies being constructed of two or more lateral arrays of said panels that are arranged in parallel relationship with respect to each other;

a plurality of corner pultrusion members, one of each of said corner pultrusion members corresponding to a respective one of the polygonal edges of said deck panel sub-assembly, each of said corner pultrusion members having first and second legs that are oriented substantially orthogonal with respect to each other, said first leg defining one slot that is laterally dimensioned to receive a side of said panel member, said second leg defining two parallel slots that are each dimensioned to receive a side of one of said panel members, said corner pultrusions connecting one polygonal side edge of the deck panel sub-assembly to one of said side-wall sub-assemblies such that said deck panel subassembly cooperates with said side-wall sub-assemblies to define an enclosure; and a mounting pultrusion that has a base surface and a top surface that is oppositely disposed from the base surface, the top surface of said mounting pultrusion defining two parallel slots with each of said slots being dimensioned to receive an edge of a respective panel member, said mounting pultrusion receiving at last one side-wall sub-assembly and cooperating with said side-wall sub-assembly to provide support for the enclosure that is defined by the deck panel sub-assembly and the side-wall sub-assemblies.

8. The enclosure system of claim 7 wherein said panel members comprise first and second sheets that are substantially parallel and that are spaced-apart by a plurality of internal webs.

9. The enclosure system of claim 7 wherein at least one mounting pultrusion has a base surface that is connected to the interior surface of the deck panel sub-assembly and at least one panel member is received in the slot that is defined by the top surface of the mounting pultrusion member such that said panel member operates as a truss to provide vertical support to the deck panel sub-assembly.

10. The enclosure system of claim 9 wherein at least one mounting pultrusion has a base surface that is connected to the interior surface of one of said side-wall sub-assemblies and the slot that is defined in the top surface of the mounting pultrusion receives one end of the panel member that operates as a truss to provide vertical support to the deck panel sub-assembly.

11. The system of claim 7 further comprising:

a bottom sheet that is connected to the mounting pultrusions, said sheet cooperating with the enclosure defined by the top sub-assembly and side sub-assemblies to define a totally enclosed facility.

12. The system of claim 11 further comprising:

two or more of said mounting pultrusions with the base of each of said mounting pultrusions being secured to the interior surface of a respective one of said side-wall sub-assemblies; and at least one panel member with each end of the panel member being received in a respective one of the two or more mounting pultrusions to provide lateral support for the side-wall sub-assemblies.

13. The system of claim 7 further comprising:

a portal trim member having a base member that is in the general shape of a rectangular bar and also have first and second fork members that extend from one longitudinal edge of the rectangular base, said fork members being spaced apart to define a slot therebetween, said slot being dimensioned to receive a side of the panel member, the slot of said portal trim member engaging the sides of the panel members that define portals in said enclosure with said base member extending into said portal to provide a contact surface at the perimeter of said portal, said contact surface cooperating with closures for said portal.

14. The system of claim 7 further comprising:

an extension member, said extension member having a plurality of side-wall sub-assemblies, one of each of said side-wall sub-assemblies corresponding to a respective one of the polygonal edges of said deck panel sub-assembly, each of said side-wall sub-assemblies being constructed of a lateral array of said panel members and at least one of said side-wall sub-assemblies being constructed of two or more side-wall sub-assemblies that are arranged in parallel relationship with respect to each other, said extension defining a internal polygonal shape that corresponds to the shape and dimensions of the side-walls of the enclosure, said extension cooperating with the side-walls of the enclosure to provide an enclosure of extended vertical height.

15. An enclosure comprising:

a panel member having oppositely disposed, parallel planar surfaces that are defined between first and second end surfaces, said planar surfaces also being defined between longitudinal edge surfaces herein one of said edge surfaces defines a longitudinal groove and wherein the oppositely disposed edge surface defines a tongue, said groove and said tongue being dimensioned such that said tongue is received in the groove of an adjacent panel member;

a corner pultrusion that has a first longitudinal slot that is laterally dimensioned to receive the groove edge of said panel member and that is also laterally dimensioned to receive the tongue edge of said panel member, said corner pultrusion also having at least one longitudinal slot that receives the tongue edge of one of said panel members; and a mounting pultrusion that includes a base and sidewalls that define a slot therebetween, said slot further including at least one divider wall that is oriented longitudinally in said slot such that said divider wall cooperates with said side-walls to define two parallel grooves, said grooves being dimensioned in lateral cross-section to receive a longitudinal side of said panel member.

16. The enclosure of claim 15 further comprising:

a portal trim member having a base member that is in the general shape of a rectangular bar and also, having first and second fork members that extend from one longitudinal edge of the rectangular base, said fork members being spaced apart to define a slot therebetween, said slot being dimensioned to receive a side of the panel member, the slot of said portal trim member engaging the sides of the panel members that define portals in said enclosure with said base member extending into said portal to provide a contact surface at the perimeter of said portal, said contact surface cooperating with closures for said portal.

17. The enclosure of claim 15 further comprising:

an extension member, said extension member having a plurality of side-wall sub-assemblies, one of each of said side-wall sub-assemblies corresponding to a respective one of the polygonal edges of said deck panel sub-assembly, each of said side-wall sub-assemblies being constructed of a lateral array of said panel members and at least one of said side-wall sub-assemblies being constructed of two or more side-wall sub-assemblies that are arranged in parallel relationship with respect to each other, said extension defining a internal polygonal shape that corresponds to the shape and dimensions of the side-walls of the enclosure, said extension cooperating with the side-walls of the enclosure to provide an enclosure of extended vertical height.

18. A method for transporting a pedestal that supports at least one vertically extending component, where the total height of said pedestal and said vertically extending component exceeds the height restrictions for the transport vehicle, said method comprising:

assembling a pad that has a deck sub-assembly and side-wall sub-assemblies, said pad also having a deck sub-assembly that is connected to each of the side-wall sub-assemblies and defines a given polygonal shape;

connecting the vertically extending component to the pad;

placing the pad and the vertically extending components on a transportation vehicle for shipment to another location; and positioning an extension on top of the pad, wherein said extension has side-wall sub-assemblies that define a top opening that has substantially the same shape as the shape of said pad and wherein said side-wall sub-assemblies of said extension surround said vertically extending member.

19. The method of claim 18 further comprising the steps of:

transporting the pad and extension member to a predetermined location;

removing the extension member from the vehicle;

positioning the extension member in a predetermined location; and placing the pad on top of the extension member.

20. An enclosure system for assembling enclosures from multipurpose components, said system comprising:

a deck panel sub-assembly that defines a plurality of polygonal edges, said deck panel sub-assembly being constructed from a lateral array of panel members, each of said panel members having a first longitudinal side that includes an extending tongue and a second longitudinal side that includes a groove, the tongue of the first longitudinal side being dimensioned with respect to the groove of the second longitudinal side such that the tongue of one panel member is engagingly received in the groove of a laterally adjacent panel member;

a plurality of side-wall sub-assemblies, one of each of said side-wall sub-assemblies corresponding to a respective one of the polygonal edges of said deck panel sub-assembly, each of said side-wall sub-assemblies being constructed of a lateral array of said panel members;

a plurality of corner pultrusion members that connect adjacent side-wall sub-assemblies and that are connected to the bottom surface of the side-wall sub-assemblies, each of said corner pultrusion members having first and second legs that are oriented substantially orthogonal with respect to each other, each of said first and second legs defining a slot that is laterally dimensioned to receive a side of said panel member; and a side cap that corresponds to each of the respective side-wall sub-assemblies 24, said side cap including first and second fingers that are connected to a base, said first and second fingers being spaced apart to define a slot having a width that is substantially equal to the width of the tongue of said panel member such that the tongue is engagingly received in the slot of said side cap.

21. The enclosure system of claim 20 including at least one additional mounting pultrusion member wherein the base surface of the mounting pultrusion member is connected to the interior surface of the deck panel sub-assembly and at least one panel member is received in the slot that is defined by the top surface of the additional mounting pultrusion member such that said panel member operates as a truss to provide vertical support to the deck panel sub-assembly.

22. The enclosure system of claim 21 wherein a second additional mounting pultrusion member has a base surface that is connected to the interior surface of one of said side-wall sub-assemblies and the slot that is defined in the top surface of the second additional mounting pultrusion member receives one end of the panel member that operates as a truss to provide vertical support to the deck panel sub-assembly.

23. The system of claim 22 further comprising two or more mounting pultrusion members with the base of each of said mounting pultrusion members being secured to the interior surface of a respective one of said side-wall sub-assemblies; and at least one panel member with each end of the panel member being received in a respective one of the two or more mounting pultrusion members to provide lateral support for the side-wall sub-assemblies.

24. The enclosure system of claim 20 wherein said side cap further includes a riser panel that is connected to the base of said side cap.

* * * * *